US007443990B2

(12) United States Patent
Chattin

(10) Patent No.: US 7,443,990 B2
(45) Date of Patent: Oct. 28, 2008

(54) VOLTAGE BIASED CAPACITOR CIRCUIT FOR A LOUDSPEAKER

(76) Inventor: Daniel A. Chattin, 75 Perkins Hill Rd., Harwinton, CT (US) 06791

( * ) Notice: Subject to any disclaimer, the term of this patent is extended or adjusted under 35 U.S.C. 154(b) by 934 days.

(21) Appl. No.: 10/978,766

(22) Filed: Nov. 1, 2004

(65) Prior Publication Data

US 2006/0093162 A1 May 4, 2006

(51) Int. Cl.
*H04R 3/00* (2006.01)

(52) U.S. Cl. ..... 381/111; 381/55; 381/116

(58) Field of Classification Search ..... 381/111, 381/98–99, 116–117, 55, 120; 330/251, 330/10, 69, 207, 297
See application file for complete search history.

(56) References Cited

U.S. PATENT DOCUMENTS 3,838,215 A 9/1974 Haynes, Jr.
4,074,070 A 2/1978 Gaus
4,475,233 A 10/1984 Watkins
4,524,247 A 6/1985 Lindenberger et al.
4,593,405 A 6/1986 Frye et al.
4,597,100 A * 6/1986 Grodinsky et al. ..... 381/99
4,606,071 A * 8/1986 White, Jr. ..... 381/99
4,928,048 A 5/1990 Doyle
5,123,052 A 6/1992 Brisson
5,153,915 A * 10/1992 Farella ..... 381/99
5,297,122 A * 3/1994 Christie ..... 369/13.34
5,636,284 A 6/1997 Pritchard
5,754,667 A 5/1998 Nazar et al.
6,381,334 B1 * 4/2002 Alexander ..... 381/99
6,707,919 B2 * 3/2004 Koval et al. ..... 381/100
6,771,781 B2 8/2004 Chattin

* cited by examiner

*Primary Examiner*—Vivian Chin
*Assistant Examiner*—Disler Paul
(74) *Attorney, Agent, or Firm*—Malcolm J. Chisholm, Jr.

(57) ABSTRACT

A voltage biased capacitor circuit (10) for a loudspeaker (14') includes at least two audio circuit capacitors (32A, 32B) wired in series either on one of an audio connector or between audio connectors (16A', 16B'). A direct current voltage source (34) is wired in electrical communication with the audio circuit capacitors (32A, 32B) for transmitting through direct current voltage connectors (36A, 36B) a direct current to provide a bias voltage to the audio circuit capacitors (32A, 32B). At least one resistor (37) is secured between the audio circuit capacitors (32A, 32B) and the voltage source (34), to prevent dissipation of an audio signal through the resistor (37) and direct current voltage connectors (36A, 36B). A voltage source capacitor (40) is also wired between the voltage source (34) and the audio connectors (16A' 16B') to stabilize the direct current transmitted to the capacitors (32A, 32B).

8 Claims, 1 Drawing Sheet

VOLTAGE BIASED CAPACITOR CIRCUIT FOR A LOUDSPEAKER

TECHNICAL FIELD

The present invention relates to loudspeaker systems and in particular relates to a circuit for reducing distortion in sound reproduction by a loudspeaker.

BACKGROUND OF THE INVENTION

It is well known that high fidelity audio reproduction systems and their loudspeakers have substantially improved in quality in recent years, yet they still suffer from persistent problems. Many of the problems are associated with component audio reproduction systems wherein differing power amplifiers may be utilized with a variety of differing loudspeakers and the different amplifiers and loudspeakers have distinct operating characteristics. For example, the present inventor's own U.S. Pat. No. 6,771,781 disclosed a "variable damping circuit for a loudspeaker" that significantly enhances audio reproduction.

In modern component audio reproduction systems, it is common for two or more loudspeakers to be secured within a common enclosure having a large speaker referred to as a "woofer" for low or bass frequencies and having a small speaker referred to as a "tweeter" for high or treble frequencies of an audio signal generated by the amplifier and transmitted to the loudspeakers. Some such speaker enclosures even have a separate mid-range speaker. For such multiple loudspeaker enclosures or "speaker boxes", a special circuit referred to as a "cross-over network" or a "frequency dividing network" is typically utilized to filter desired low range frequencies to the woofers and high range frequencies to the tweeter, as is well known. It is also known to have such cross-over networks within the amplifier and to have bass and treble speakers within separate speaker boxes at varying locations within a user's listening room.

While such cross-over networks have substantially increased high fidelity reproduction of recorded music, it is also known that unacceptable distortion often results from such sound reproduction cross-over networks. For example and as disclosed in U.S. Pat. No. 4,597,100 that issued on Jun. 24, 1986 to Grodinsky, et al., a form of distortion referred to as "time displacement distortion" results from stored energy in many electrical components of audio circuits. An example of such distortion includes capacitors in audio reproduction circuits being unable to release stored energy rapidly. It is known that capacitors are utilized in frequency cross-over networks. Grodinsky et al. proposes use of frequency independent energy dissipation components and radio frequency chokes to suppress induced radio frequency distortion within a cross-over network.

U.S. Pat. No. 4,475,233 to Watkins shows another endeavor to improve the sound reproduction associated with cross-over networks through use of resistive damping of coils, capacitors and loudspeaker drive units to suppress loudspeaker ringing associated with cross-over networks. Similarly, in U.S. Pat. No. 5,132,052 to Brisson, an attempt to improve sound reproduction in an audio system is disclosed by use of a discrete capacitor coupled in parallel with one of the audio signal conductor lines. While all of such known attempts to improve audio reproduction have produced modest improvements, there is nonetheless a significant level of distortion within known audio systems.

Accordingly, there is a need for an improved audio system that enhances reproduction of sound.

SUMMARY OF THE INVENTION

The invention is a voltage biased capacitor circuit for a loudspeaker, that includes an amplifier, at least one loudspeaker, and a pair of audio connectors electrically connected between the amplifier and the loudspeaker for transmitting an audio signal between the amplifier and the loudspeaker. At least two audio circuit capacitors are wired in series either on one of the audio connectors or between the audio connectors. A direct current voltage source is wired in electrical communication with the audio circuit capacitors for transmitting through direct current voltage connectors a direct current to provide a bias voltage to the audio circuit capacitors. At least one resistor is secured between the audio circuit capacitors and the direct current voltage source, and the resistor has a resistance value sufficient to prevent dissipation of the audio signal from the audio connectors through the resistor and direct current voltage connectors. A voltage source capacitor is also wired between the voltage source and the audio connectors to stabilize the direct current transmitted to the audio circuit capacitors.

It is believed that because a loudspeaker of an audio reproduction system is essentially passive, the audio capacitors receive no dynamic charge through ordinary operation of the loudspeaker. Therefore, by the present invention of providing a direct current charge to a pair of audio circuit capacitors, the electrical charge storing dielectric of the capacitors is saturated by the charge. The audio circuit capacitors are thereby prohibited from becoming involved with the audio signal passing through the capacitors during use of the loudspeaker. Consequently, any time distortion associated with audio capacitors is minimized or greatly reduced by the present invention.

In a preferred embodiment, the direct current voltage applied to the audio capacitors is equal to or greater than a maximum audio signal voltage passing through the audio circuit capacitors. Additionally, the pair of audio capacitors has a combined series capacitance that is equivalent to a capacitance of a predetermined capacitance value of a single audio circuit capacitor that produces optimal performance of the loudspeaker. For example if the loudspeaker is part of an audio reproduction system utilizing a cross-over network, and the cross-over network includes a single audio circuit capacitor having a predetermined capacitance value for optimal performance of the loudspeaker, then the present invention proposes replacement of that single audio circuit capacitor with a pair of audio circuit capacitors wherein each of the capacitors of the pair may have a capacitance that is double the predetermined capacitance of the single capacitor. This will achieve the same total capacitance based upon the known inverse law of multiple capacitors. The invention also includes using more than a pair of audio capacitors, wherein the capacitance of each replacement capacitor is a function of the number of replacement capacitors times a predetermined capacitance value for optimal performance of the loudspeaker.

In a further preferred embodiment, the invention includes two or more loudspeakers in electrical connection by two more pairs of audio connectors, wherein each pair of audio connectors includes at least a pair of audio circuit capacitors for purposes such as a cross-over network. The direct current voltage source is wired in electrical communication with the audio circuit capacitors for transmitting through direct current voltage connectors a direct current to provide a bias voltage to the audio circuit capacitors. One or more resistors are secured between the audio circuit capacitors and the direct current voltage source, and the resistors have a resistance value sufficient to prevent dissipation of the audio signal from the audio connectors through the resistors and direct current voltage connectors. A voltage source capacitor is also wired between the voltage source and the audio connectors to stabilize the direct current transmitted to the audio circuit capacitors.

The direct current voltage source may be a battery, or may be derived from electrical current within the amplifier. The exact source of the direct current voltage is irrelevant to the disclosed invention.

The voltage biased capacitor circuit for a loudspeaker of the present invention therefore minimizes distortion resulting from use of capacitors in association with loudspeakers, such as in cross-over networks.

Accordingly, it is a general purpose of the present invention to provide voltage biased capacitor circuit for a loudspeaker that overcomes deficiencies of prior art loudspeaker damping circuits.

It is a more specific purpose to provide voltage biased capacitor circuit for a loudspeaker that minimizes distortion resulting from use of capacitors in a cross-over network.

These and other objects and advantages of this invention will become more readily apparent when the following description is read in conjunction with the accompanying drawings.

DESCRIPTION OF THE PREFERRED EMBODIMENTS

Figure 1:
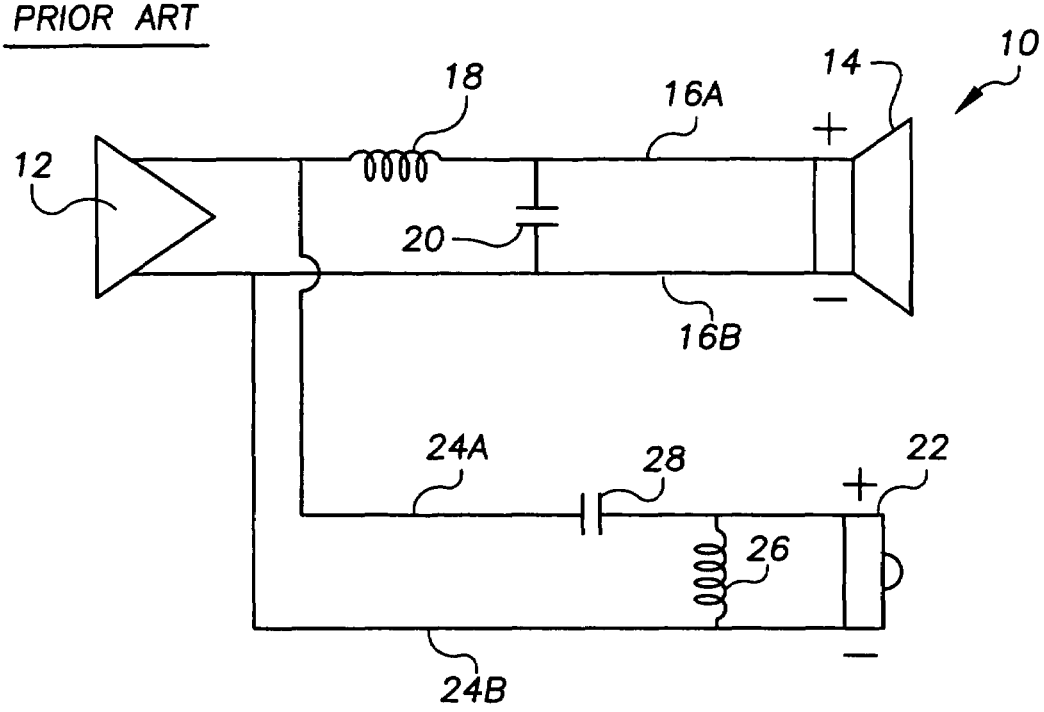
FIG. 1 PRIOR ART
FIG. 1 is a schematic circuit diagram of a prior art embodiment of an audio reproduction system showing an amplifier connected by a pair of audio connectors and a cross-over network to two loudspeakers.

Referring to the drawings in detail, a prior art audio reproduction system is shown schematically in FIG. 1, and is generally designated by the reference numeral 10. The prior art system 10 includes an amplifier 12, a first loudspeaker 14, such as a bass loudspeaker, connected by a first pair of audio connectors 16A, 16B to the amplifier 12, a first reactive component, such as a first coil 18 connected to the audio connector 16A and a first audio capacitor 20 connected between the audio connectors 16A, 16B. The prior art audio reproduction system 10 may also include a second loudspeaker 22, such as a treble loudspeaker, connected by a second pair of audio connectors 24A, 24B to the amplifier 12, a second reactive component, such as second coil 26, and a second audio capacitor 28. The prior art audio reproduction system 10 shows schematically a well known cross-over network wherein the capacitance of the first and second audio capacitors 20, 28 are selected to filter bass frequencies to the bass loudspeaker 14 and treble frequencies to the treble loudspeaker 22. Such a cross-over network may be integral with the bass and treble loudspeakers 14, 22 within a common loudspeaker enclosure (not shown), or the network may be integral with the amplifier and the bass and treble loudspeakers 14, 22 may be in separate enclosures (not shown), as is common in the art.

Figure 2:
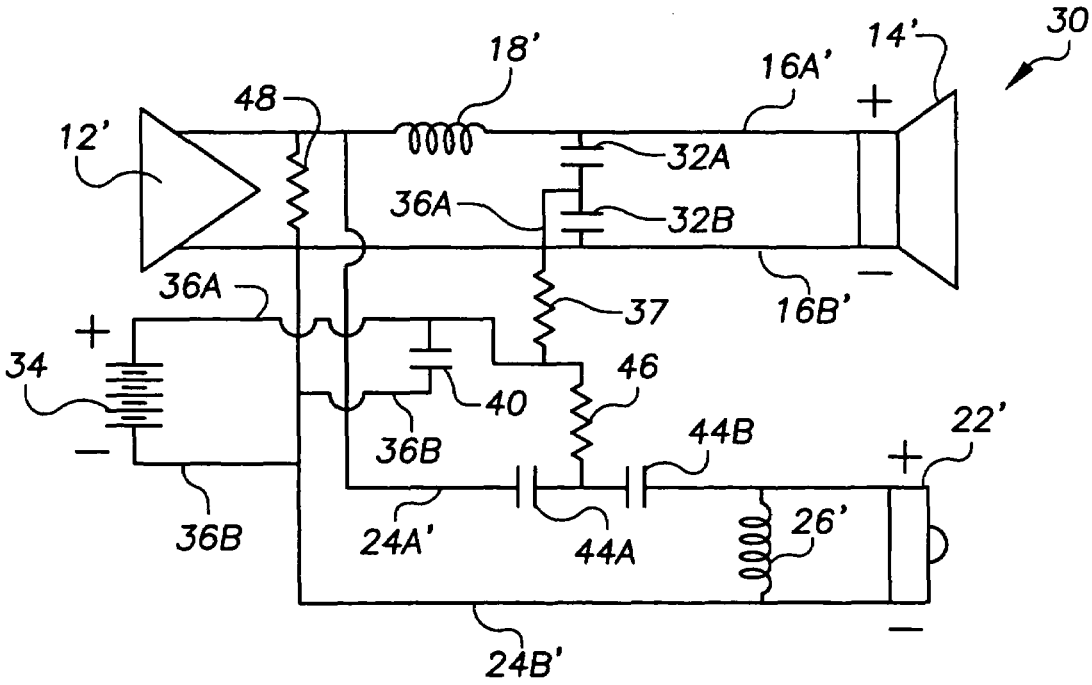
FIG. 2 is a schematic circuit diagram of a voltage biased capacitor circuit for a loudspeaker constructed in accordance with the present invention.

A voltage biased capacitor circuit for a loudspeaker 30 of the present invention is shown in FIG. 2. (Components of the voltage biased capacitor circuit 30 that are virtually identical to FIG. 1 prior art components are shown in FIG. 2 with reference numerals that are primes of the prior art system 10 components.) The voltage biased capacitor circuit 30 includes an amplifier 12', a first loudspeaker 14', such as a bass loudspeaker, connected by a first pair of audio connectors 16A', 16B' to the amplifier 12', and a first reactive component 18' connected to the audio connector 16A'. A second loudspeaker 22', such as a treble loudspeaker, may be connected by a second pair of audio connectors 24A', 24B' to the amplifier 12', and a second reactive component such as a second coil 26' may be secured to or between the second pair of audio connectors 24A', 24B', in the same manner as the prior art system 10.

The voltage biased capacitor circuit 30 also includes at least two audio circuit capacitors 32A, 32B wired in series either between the first pair of audio connectors 16A', 16B' (as shown in FIG. 2), or wired in series on one of the connectors 16A', 16B' (not shown). A direct current voltage source 34 is wired through direct current voltage connectors 36A, 36B to the audio circuit capacitors 32A, 32B for transmitting a direct current to bias the audio circuit capacitors 32*a*, 32B. A first direct current resistor 37 is secured between the audio circuit capacitors 32A, 32B and the direct current source 34. The resistance value of the direct current resistor 37 is sufficiently high to prevent dissipation of the audio signal passing through the audio connectors 16A, 16B into and through the direct current resistor 37 and the direct current voltage connectors 36A, 36B. A voltage source capacitor 40 is wired between the direct current voltage source 34 and the audio connectors 16A', 16B' to stabilize the direct current transmitted to the audio circuit capacitors 32A, 32B, and to shunt any current leakage between the first pair of audio capacitors 32A, 32B and a second pair of audio capacitors 44A, 44B.

In a preferred embodiment, as shown in FIG. 2, the voltage biased capacitor circuit 30 may also include the second pair of audio capacitors 44A, 44B wired in series either on one of the second pair of audio connectors 24A', 24B' (as shown in FIG. 2), or wired in series between the second pair of audio connectors 24A', 24B' (not shown), along with a second direct current resistor 46. As with the first direct current resistor 37, the second direct current resistor 46 has a resistance value sufficient to prevent dissipation of an audio signal in the second pair of audio connectors 24A', 24B' from passing through the second direct current resistor 46 and the direct current connectors 36A, 36B.

In use of the voltage biased capacitor circuit 30 for a loudspeaker, it has been found that any direct current voltage applied to the audio capacitors 32A, 32B, 44A, 44B enhances performance of the loudspeakers 14', 22'. However, it has also been determined that a direct current voltage applied from the direct current source 34 that is equal to or greater than a maximum audio signal passing through the audio connectors 16A', 16B', 24A', 24B' provides optimal performance of the loudspeakers 14', 22'.

The first pair of audio capacitors 32A, 32B, or the second pair of audio capacitors 44A, 44B may have a combined series capacitance that is equivalent to a capacitance of a predetermined capacitance value of a single audio circuit capacitor that produces optimal performance of the loudspeakers 14', 22'. For example, the capacitance of the first pair of audio capacitors 32A, 32B may be twice the predetermined capacitance of a single capacitor designed for optimal performance of the first loudspeaker 14'. If in the prior art FIG. 1 audio reproduction system, the first audio capacitor 20 has a predetermined capacitance of ten micro-farads, then each of the capacitors 32A, 32B of the first pair of audio capacitors would each have a capacitance of twenty micro-farads, or any of a combination of capacitances that achieves a combined series capacitance that is equivalent to the ten micro-farads. As is known, this will achieve the same total capacitance as the predetermined capacitance for optimal performance of the first loudspeaker 14.

The voltage biased capacitor circuit 30 also includes using more than the described first and second pairs of audio capacitors 32*a*, 32B, 44A, 44B. Instead, each of the pairs of audio connectors 16A', 16B', 24A', 24B' may have two or more capacitors (not shown), wherein capacitance of each replacement capacitor (not shown) is a function of the number of replacement capacitors times a predetermined capacitance value of a single capacitor for optimal performance of the loudspeakers 14', 22'.

An additional fourth resistor 48 may also be included wired between the audio connectors 16A', 16B' to provide a return path between the audio connectors 16A', 16B' for the direct current supplied by the direct current source 34 so that an equal sized charge will be supplied by the direct current source to both sides of each of the audio capacitors 32A, 32B, 44A, 44B. In a typical audio reproduction system, circuitry would provide such a return path between known audio connectors. However, to stress that such a path is needed, the fourth resistor 48 is shown in FIG. 2 wired between the audio connectors 16A', 16B' to emphasize that the direct current provided by the direct current source is to supply an equal charge to opposed sides of each audio capacitor 32A, 32B, 44A, 44B. The resistance value of the fourth capacitor is sufficiently high to prevent transmission of the audio signal between the audio connectors 16A', 16B', 24A', 24B', and is low enough to permit transmission of the direct current voltage between the audio connectors 16A', 16B', 24A', 24B'.

Use of the voltage biased capacitor circuit 30 has demonstrated dramatically enhanced performance of any audio reproduction system using a loudspeaker and has virtually eliminated distortion resulting from use of capacitors 20, 28 and other system components.

While the present invention has been described and illustrated with respect to particular descriptions and illustrations of preferred embodiments of the voltage biasing capacitor circuit 10 for a loudspeaker 14', 22', it should be understood that the invention is not limited to the described and illustrated examples. For example, while the above described and illustrated embodiments of the variable damping circuit 30 for a loudspeaker describe only one loudspeaker connected to a pair of audio connectors wired to one pair of audio capacitors (e.g., the first loudspeaker 14' wired to the first pair of audio capacitors 32A, 32B), it is to be understood that more than one loudspeaker could be wired to the audio connectors 16A', 16B' and the first pair of audio capacitors 32A, 32B. Accordingly, reference should be made primarily to the attached claims rather than to foregoing description to determine the scope of the invention.

What is claimed is:

1. A voltage biased capacitor circuit (30) for a loudspeaker, comprising:

a. an amplifier (12');

b. at least one loudspeaker (14');

c. a pair of audio connectors (16A', 16B') electrically connected between the amplifier (12') and the loudspeaker (14') for transmitting an audio signal between the amplifier (12') and the loudspeaker (14');

d. at least two audio circuit capacitors (32A, 32B) wired in series either on one of the audio connectors or between the audio connectors (16A', 16B');

e. a direct current voltage source (34) wired in electrical communication with the audio circuit capacitors (32A, 32B) for transmitting through direct current voltage connectors (36A, 36B) a direct current to provide a bias voltage to the audio circuit capacitors (32A, 32B); and, f. at least one direct current resistor (37) secured between the audio circuit capacitors (32A, 32B) and the direct current voltage source (34), the resistor (37) having a resistance value sufficient to prevent dissipation of the audio signal from the audio connectors (16A', 16B') through the resistor (37) and direct current voltage connectors (36A, 36B).

2. The voltage biased capacitor circuit (30) of claim 1, wherein the direct current voltage transmitted to the audio circuit capacitors (32A, 32B) is equal to or greater than a maximum audio signal voltage passing through the audio circuit capacitors (32A, 32B).

3. The voltage biased capacitor circuit (30) of claim 1, wherein the audio circuit capacitors (32A, 32B) have a combined series capacitance that is equivalent to a capacitance of a predetermined capacitance value of a single audio circuit capacitor (20) that produces optimal performance of the loudspeaker (14').

4. The voltage biased capacitor circuit (30) of claim 1, further comprising a second pair of audio connectors (24A', 24B') wired between the amplifier (12') and a second loudspeaker (22'), a second pair of audio capacitors (44A, 44B) wired in series either on one of the second pair of audio connectors (24A', 24B') or between the second pair of audio connectors (24A', 24B'), a second direct current resistor (46) having a resistance value sufficient to prevent dissipation of the audio signal from the audio connectors (24A', 24B') through the second resistor (46) and direct current voltage connectors (36A, 36B), and a voltage source capacitor (40) wired between the direct current voltage source (34) and the first and second audio connectors (16A', 16B', 24A', 24*b*') to shunt any audio current leakage between the first pair of audio capacitors (32A, 32B) and the second pair of audio capacitors (44A, 44B) and to stabilize the direct current transmitted to the audio circuit capacitors (32A, 32B, 44A, 44B).

5. The voltage biased capacitor circuit (30) of claim 1, wherein the voltage source (34) is a battery.

6. The voltage biased capacitor circuit (30) of claim 1, wherein the voltage source (34) is derived from a non-audio signal voltage of the amplifier.

7. The voltage biased capacitor circuit (30) of claim 1, further comprising additional audio capacitors wired in series either on one of the audio connectors or between the audio connectors (16A', 16B').

8. The voltage biased capacitor circuit (30) of claim 1, further comprising a fourth resistor (48) wired between the pair of audio connectors (16A', 16B'), the fourth resistor (48) providing a return path between the audio connectors (16A', 16B') for the direct current supplied by the direct current source (34) to the pair of audio capacitors (32A, 32B), the fourth resistor (48) having a resistance value sufficiently high to prevent transmission of the audio signal between the audio connectors (16A', 16B') and sufficiently low to permit transmission of the direct current voltage between the audio connectors (16A', 16B').

* * * * *